United States Patent [19]

Hall

[11] Patent Number: 4,901,877

[45] Date of Patent: Feb. 20, 1990

[54] BEE PROOF BEVERAGE CONTAINER

[76] Inventor: John R. Hall, 3920 Brandy Station Ct., Atlanta, Ga. 30339

[21] Appl. No.: 376,845

[22] Filed: Jul. 7, 1989

[51] Int. Cl.[4] ..... B65D 17/32

[52] U.S. Cl. ..... 220/90.4; 220/269

[58] Field of Search ..... 220/90.2, 90.4, 90.6, 220/266, 268, 269, 277

[56] References Cited

U.S. PATENT DOCUMENTS

| | | | |
|---|---|---|---|
| 2,106,453 | 1/1938 | Ekdahl | 220/90.4 X |
| 2,927,695 | 3/1960 | Bartolomeo | 210/464 |
| 3,292,828 | 12/1966 | Stuart | 222/485 |
| 3,301,459 | 1/1967 | Gardner | 220/90.6 X |
| 3,938,695 | 2/1976 | Ruff | 220/90.4 |
| 4,020,969 | 5/1977 | Ando | 220/90.2 X |
| 4,085,861 | 4/1978 | Ruff | 220/90.6 X |
| 4,331,255 | 5/1982 | Fournier | 220/90.4 X |
| 4,463,866 | 8/1984 | Mandel | 220/269 |
| 4,537,326 | 8/1985 | Morehead | 220/269 |
| 4,619,372 | 10/1986 | McFarland | 220/90.4 |

*Primary Examiner*—Steven M. Pollard

*Attorney, Agent, or Firm*—Hurt, Richardson, Garner, Todd & Cadenhead

[57] ABSTRACT

A container with a lid which is provided with scorelines defining a plurality of long narrow lugs. A tab is secured by its midportion to the central portion of the lid and has at one end a plurality of fingers which respectively terminate over the lugs for pushing the lugs into the container when the tab is lifted. The displaced lugs leave parallel, narrow slits which preclude the entry of insects, such as bees, into the container.

8 Claims, 1 Drawing Sheet

BEE PROOF BEVERAGE CONTAINER

BACKGROUND OF THE INVENTION

This invention relates to a pop-top beverage container and is more particularly concerned with a bee proof beverage container.

In the past, pop-top beverage containers have been extensively used for containing soft drinks and other consumable liquids. Such pop-top containers have aluminum tops to which are affixed operating tabs. The operating tab is conventionally used for separating a prescored portion of the can top from the remaining top and depressing the flap into the can. The tab is conventionally connected to a rivet pin at the center of the can top and operates as a lever with a minimal lifting portion on one side of the pin and reacting detent portion on the other side of the pin, which engages the edge of the scored flap for depressing the flap into the can or container.

Once open, the can is not resealable and provides a relatively wide opening through which various insects, such as bees and hornets, can enter the interior of the can. Once in the interior, the insect usually eventually falls into the liquid and remains there. A person drinking the beverage, cannot detect, from looking at the outside of the container, whether or not an insect is in the container. Thus, from time to time, persons who drink these soft drinks out of doors, such as in a person's backyard or on the golf course, will find that, a bee or hornet or other insect will be floating in the liquid and will be received in a person's mouth. Usually there are no serious consequences to receiving the bee or hornet in a person's mouth since the person will usually spit out the liquid, before the insect has attacked him. Nevertheless, the shock of finding a bee or hornet in a person's beverage usually convinces a person not to drink any more of the liquid contained in that particular open container.

In the past, efforts have been made to protect the opening of a pop-top type container so as to prevent or preclude the likelihood that foreign matter will be accumulated in the liquid carried by the container. The patent to Morehead U.S. Pat. No. 4,537,326 recognizes the applicant's problem but does not provide applicant's solution to that problem. Specifically, Morehead teaches to provide a protector for the opening which is a flat cover having a number of small apertures. The cover is pivotally mounted to the top of the container so that it may be rotated into a position over the opening of the container, once the container has been opened. The cover has a plurality of spaced, parallel slits which will permit the liquid to pass through the slits when a person drinks or pours from the can. Of course, the provision of an additional element, namely the protector to the aluminum top is relatively expensive, and furthermore, a person opening the drink, must remember to pivot the protector into a position where it overlies the opening.

The patent to Stuart U.S. Pat. No. 3,292,828 discloses a pull tab-type can closure wherein the openings are very small so as to protect children from cutting their fingers on the edges of the can.

The patent to Bartolomeo U.S. Pat. No. 2,927,695 teaches to dispose a screen over the opening of a milk carton to prevent ingress of insects or the like.

The patent to Mandel U.S. Pat. No. 4,463,866 teaches to provide a resealable construction for the pop-top can so that the resealing of the can or container will preclude foreign objects from ending up within the can.

None of this prior art provides a pop-top container which when opened, automatically provides slits through which an insect cannot readily pass.

SUMMARY OF THE INVENTION

Briefly described, the present invention includes a hollow body of a container for a beverage or some other consumable liquid. The end of this body is closed by a conventional aluminum top having a tab which is pivotally mounted in conventional fashion on the top. The inventive concept of the present invention is the provision of a plurality of individual outwardly protruding fingers on the end of the detent of the tab and which fingers will move downwardly as the tab is lifted so as to depress, simultaneously, prescored lugs of the container top. These lugs are arranged in spaced parallel closely adjacent relationship and correspond in number to the number of fingers on the detent. Thus, each individual finger acts upon an individual lug so as to break it away from at least a portion of the remainder of the lid and depress the same downwardly, thereby providing parallel slits in the lid through which the liquid can pass.

Accordingly, it is an object of the present invention to provide a container with an openable top which will provide a plurality of narrow openings, each of which is sufficiently small that an insect, such as a bee or hornet cannot crawl or fly through that opening.

Another object of the present invention is to provide a bee proof beverage container which is inexpensive to manufacture, durable in structure and efficient in operation.

Another object of the present invention is to provide a bee proof beverage container which can be manufactured as easily and readily as a conventional beverage container and which has the added capability of protecting the liquid from becoming contaminated.

Another object of the present invention is to provide a bee proof beverage container which can be safely used out of doors.

Other objects, features, and advantages of the present invention will become apparent from the following description when taken in conjunction with the accompanying drawings wherein like characters of reference designate corresponding parts throughout the several views.

DETAILED DESCRIPTION

Figure 1:
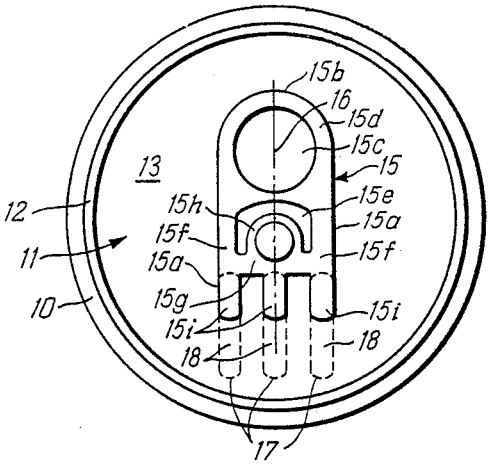
FIG. 1 is a plan view of a bee proof beverage container constructed in accordance with the present invention.
Figure 2:
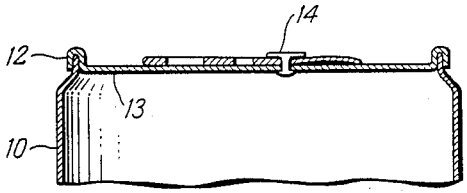
FIG. 2 is a cross-sectional view taken substantially along line 2—2 in FIG. 1.
Figure 3:
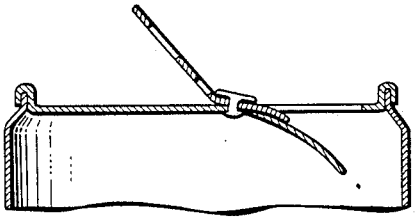
FIG. 3 is a cross-sectional view similar to FIG. 2 but showing the tab in its lifted position such as when the container is opened and the lugs depressed to their open position.

Referring now in detail to the embodiment chosen for the purpose of illustrating the present invention, numeral 10 denotes generally the body of a beverage container, can or closure of the present invention. This container body 10 is preferably cylindrical and receives on its open end portion, a lid, cap or top 11 of the container. This top 11 is provided with a conventional reversibly bent rim 12 which overlies and is secured to the edge portion of the container body 10. The web 13 of the lid, cap or top 11 extends across the open end of body 10. An upstanding axially disposed fulcrum pin 14 is mounted on the central portion of web 13.

Received on the fulcrum pin 14 is an opening tab, denoted generally by the numeral 15. The opening tab 15 is a relatively rigid, stamped metal member which is received generally flat on the central portion of the outer surface of web 13 of lid 11. The tab 15 is defined by straight, parallel side edges 15, 15*a* which merge into a convex, rear edge 15*b* at rear end of the tab 15. Inwardly of the rear edge 15*b* is a circular finger hole 15*c* formed in the front end of tab 15. Thus, there is generally a lifting ring or annulus 15*d* on one end portion of the tab 15.

Forwardly of hole 15*c* and in about the central portion of tab 15 is a generally U-shaped hole 15*e*. This hole 15*e* divides the tab 15 into two longitudinally extending, spaced parallel pivot arms 15*f* connected by their ends to the lift ring 15*d* and by their other ends to detent plate 15*g*.

The inner central portion of the detent plate 15*g* protrudes into the hole 15*e* to provide a hinge member 15*h* through which the fulcrum brad or pin 14 protrudes. This pin 14 and hinge member 15*h* form the sole link of the tab 15 to the web 13. Thus, when the lift ring 15*d* is moved outwardly, away from the surface of web 13, the arms 15*f* pivot the detent plate 15*g* downwardly as the hinge member 15*h* bends.

Protruding forwardly from the transverse forward edge of the detent plate 15*g* are a plurality of spaced, parallel, camming fingers 15*i*. In the present embodiment, I have illustrated three spaced, parallel camming fingers 15*i*, the central finger 15*i* lying along the longitudinal centerline 16 of tab 15 and the other two fingers 15*i* lying laterally on opposite sides outwardly of the central finger 15*i*.

The distal ends of the camming fingers 15*i* are rounded or convexed while the proximal ends of fingers 15*i* are integrally connected to the forward edge of detent plate 15*g*.

Respectively below and cooperating with the fingers 15*i* are a corresponding number of juxtaposed, transversely spaced, elongated, narrow, displaceable lugs 17 defined by three continuous scorelines or cut lines 17*a*. Each lug 18 is initially a portion of the web 13 which seals the can or container 10. When lugs 18 are displaced, they leave a like number of spaced, juxtaposed, parallel, narrow straight slits or slots 19 in web 13. Scorelines 17*a*, however, penetrate only partially through the thickness of the web 13 and, therefore, do not destroy the air tight, liquid tight seal by web 13. Scorelines 17*a* are denoted in FIG. 1 by broken lines in which opposed side portions of the scorelines are parallel and the ends of these parallel portions are joined by semi-circular portions.

In operation, the beverage container of the present invention is opened by simply lifting the lift ring 15*d* away from and outwardly of the web 13. This causes the detent plate 15 to move downwardly as the hinge member 15*h* bends. The ends of the fingers 15*i* thus push downwardly, respectively on the lugs 18, thereby pushing them into the interior of the container 10. A portion of the lugs 17 will remain attached to the lid and yet the slits or slots 19 will be opened sufficiently for the liquid to be readily poured out of the container. The width of each slit or slot is preferably 3/32 inch or less, thereby assuring that substantially all bees and hornets cannot pass through these slits or slots 19 and into the interior of the container.

It will be obvious to those skilled in the art that many variations may be made in the embodiment here chosen for the purpose of illustrating the present invention, without departing from the scope thereof as defined by the appended claims.

I claim:

1. A beverage container comprising, a container body for containing a liquid and a lid for closing said container body for confining said liquid in said container body, the improvement comprising, said lid being provided with a plurality of spaced scorelines for defining individually outlined, displaceable lugs in said lid, a tab having detent means carried on said lid, said detent means including means for simultaneously engaging the outer surfaces of all of said lugs and for urging said lugs simultaneously downwardly into said container, thereby providing in said lid a plurality of spaced juxtaposed slots through which the liquid can be discharged when the container is tilted.

2. The beverage container defined in claim 1 wherein said lugs are straight, narrow, elongated members and said slots are straight, narrow, and elongated.

3. The beverage container defined in claim 1 in which the maximum dimension of each of said slots is 3/32 inch.

4. The beverage container defined in claim 1 wherein said means includes a plurality of individual fingers protruding from said detent means and terminating respectively over said lugs.

5. The beverage container defined in claim 1 wherein said lugs are straight, narrow, elongated members disposed in parallel relationship to each other, and said detent means includes a plurality of fingers protruding from said detent means and terminating with their distal ends over intermediate portions of said lugs.

6. The beverage container defined in claim 5 wherein said tab has a longitudinal centerline and wherein one of said fingers extends along said centerline, the other of said fingers being on opposite sides of said one of said fingers.

7. The beverage container defined in claim 6 wherein said lugs are each straight and parallel to each other and below said fingers respectively.

8. The beverage container defined in claim 1 including a pin passing through the central portion of said tab for securing said tab on said lid.

* * * * *